United States Patent [19]

Hain

[11] Patent Number: 5,033,441

[45] Date of Patent: Jul. 23, 1991

[54] FUEL-INJECTION PUMP FOR AN INTERNAL-COMBUSTION ENGINE

[75] Inventor: Josef Hain, Leonberg, Fed. Rep. of Germany

[73] Assignee: Robert Bosch GmbH, Stuttgart, Fed. Rep. of Germany

[21] Appl. No.: 473,948

[22] PCT Filed: Jun. 16, 1989

[86] PCT No.: PCT/DE89/00394

§ 371 Date: Feb. 9, 1990

§ 102(e) Date: Feb. 9, 1990

[87] PCT Pub. No.: WO90/00224

PCT Pub. Date: Jan. 11, 1990

[30] Foreign Application Priority Data

Jul. 1, 1988 [DE] Fed. Rep. of Germany ..... 3822257

[51] Int. Cl.[5] ..... F02M 37/04

[52] U.S. Cl. ..... 123/502; 123/179 L

[58] Field of Search ..... 123/502, 179 L, 449

[56] References Cited

U.S. PATENT DOCUMENTS

| | | | |
|---|---|---|---|
| 4,334,514 | 6/1982 | Konrath | 123/502 |
| 4,359,994 | 11/1982 | Hofer | 123/502 |
| 4,366,795 | 1/1983 | Laufer | 123/502 |
| 4,378,002 | 3/1983 | Konrath | 123/179 L |
| 4,430,974 | 2/1984 | Bofinger | 123/502 |
| 4,489,698 | 12/1984 | Hofer | 123/502 |
| 4,619,238 | 10/1986 | Hain | 123/449 |
| 4,622,943 | 11/1986 | Braun | 123/179 L |
| 4,733,645 | 3/1988 | Hain | 123/179 L |
| 4,796,592 | 1/1989 | Hofer | 123/502 |
| 4,932,385 | 6/1990 | Knorreck | 123/502 |

FOREIGN PATENT DOCUMENTS

| | | |
|---|---|---|
| 0155404 | 12/1984 | European Pat. Off. . |
| 0250785 | 1/1988 | European Pat. Off. . |
| 86405 | 1/1987 | PCT Int'l Appl. . |
| 2055489 | 3/1981 | United Kingdom . |

*Primary Examiner*—Carl Stuart Miller

*Attorney, Agent, or Firm*—Michael J. Striker

[57] ABSTRACT

A fuel-injection pump for internal combustion engines, in particular a distributor fuel injection pump, which comprises a pressure control valve, a timer and conduits for communicating a feed pump with pressure chambers of the pressure control valve and the timer. The fuel-injection pump further comprises an adjustable outlet valve and a relief conduit communicating the return chamber of the pressure control valve with the adjustable outlet valve. An outlet conduit extends from a shut-off orifice of the pressure control valve, and a pressure valve is arranged in the outlet conduit for controlling flow therethrough.

11 Claims, 2 Drawing Sheets

FUEL-INJECTION PUMP FOR AN INTERNAL-COMBUSTION ENGINE

BACKGROUND OF THE INVENTION

The invention relates to a fuel-injection pump comprising a feed pump synchronously driven with the fuel injection pump and connected with the plunger chambers of a pressure control valve and a timer. A fuel-injection pump is known from German Offenlegungsschrift No. 3,148,214, in which the normally speed-proportional control pressure changing the start of injection, can be varied by a delivery valve in dependence on pressure and temperature. During cold starting, the delivery valve advances the start of injection so far that consequently sufficient time remains for the preparation of the fuel and correspondingly better ignition or combustion takes place.

A disadvantage is that, with an unfavourable configuration of the pressure-control valve, even when the injection pump is at a standstill a small gap in the shut-off orifice can be opened, and when the fuel injection pump is being started up, the delivery of the feed pump is then insufficient to build up the necessary pressure at low speeds in the return chamber, with the delivery valve closed, for the cold-start advance of the start of injection during the cold starting of the internal-combustion engine (cold-start function).

SUMMARY OF THE INVENTION

The object of the invention is a fuel-injection pump in which the cold-start function can be guaranteed by providing a counterpressure in the exhaust line. The object of the invention is achieved by providing an adjustable pressure valve in the exhaust line.

The counterpressure generated in the exhaust line by the pressure valve can be obtained by various valve designs, so that a pressure increase correction is also possible during normal functioning, without the cold-start function.

The present invention both as to its construction so to its mode of operation, together with additional objects and advantages thereof, will be best understood from the following detailed description of the preferred embodiments when read with reference to the accompanying drawings.

DESCRIPTION OF THE PREFERRED EMBODIMENTS

Figure 1:
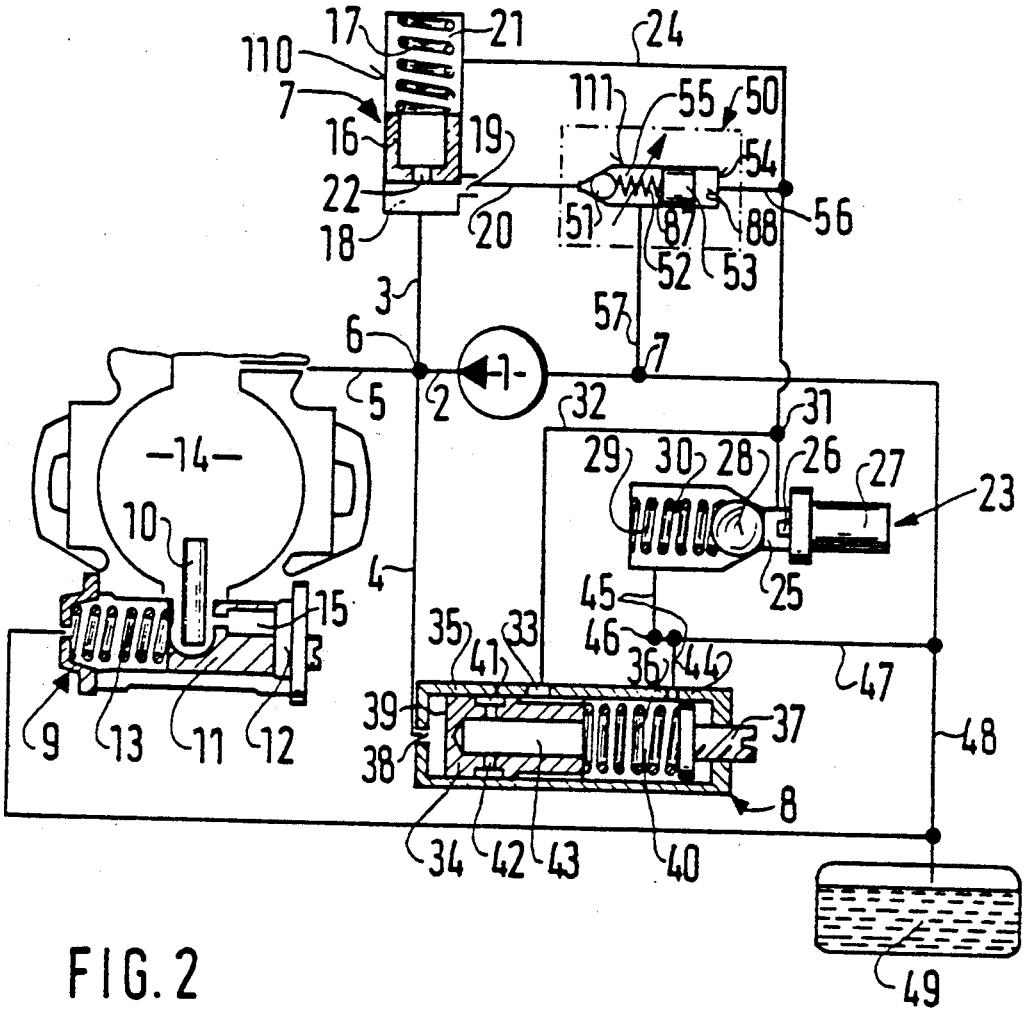
FIG. 1 shows schematically a fuel supply system with a pressure valve of a fuel-injection pump according to the invention.

FIG. 1 illustrates a distributor injection pump with a feed pump 1 which runs at the speed of the internal-combustion engine. The feed pump 1 sucks fuel from a fuel tank 49 via the feed-pump suction line 48 and conveys it via a delivery line 2, a distributor 6 and a connecting line 5 into a suction gallery 14 of the fuel-injection pump, from which the actual fuel-injection pump is supplied with fuel in a known manner. The suction gallery 14 is connected, via a bore 15 in an adjusting piston 11, to a working chamber 12 limited by the latter in a cylinder of a injection start adjusting device 9. A connecting line 3 also branches off from the distributor 6 and leads to a pressure chamber 18 of a pressure-control valve 7. The pressure-control valve 7 controls the fuel pressure prevailing downstream of the feed pump 1, that is also the pressure in the suction gallery 14, as a control pressure in dependence on the engine speed, the control pressure rising proportionally with an increasing speed. The adjusting piston 11 is displaced against a bias of a return spring 13 according to the control pressure and thereby engages with a pin 10 a cam drive, not shown, of the fuel-injection pump for adjusting the start of injection. Thus, during the normal operation of the internal-combustion engine or when the internal-combustion engine is running hot, the start of injection is "advanced" with an increasing speed. Because of the poor ignition quality of the fuel when the engine is cold, in order to ensure perfect starting, that is to say a rapid run-up of the engine with as little emission of blue smoke as possible, the start of injection must be set earlier during starting and at low speed than when the engine is warm. In order to obtain an advance even at low speeds, that is to say as early as in the starting range, the internal pressure is increased.

The pressure-control valve 7 has a piston 16 which is sealingly displaceable in a closed cylinder 110 and, as a movable wall, separates the pressure chamber 18 from a return chamber 21, and which is biased by a return spring 17 arranged in the return chamber 21 against the pressure prevailing in the pressure chamber 18. A control edge of the piston 16 controls a shut-off cross-section of a shut-off orifice 19 of an outlet line 20 leading away from the cylindrical wall of the cylinder 110 from the pressure chamber 18 to a relief chamber. The pressure chamber 18 and the return chamber 21 are connected to one another via a constant throttle 22 which is preferably provided in the piston 16. The return chamber 21 can be vented via a relief line 24.

A pressure increase necessitates a reduction of the shut-off cross-section at the shut-off orifice 19 of the pressure-control valve 7 for the quantity of fuel flowing off through the outlet line 20. The exhaust line 20 leading away from the shut-off orifice 19 is connected with a pressure cylinder 111 of a pressure valve 50. The fuel flowing out of the shut-off orifice 19 flows through this outlet line 20 and acts on a closing member 51 which is arranged in the cylinder 111 of the pressure valve 50. The closing member, here a ball 51, is biased by a closing spring 52 against a valve seat which is arranged at the entry of the outlet line 20 into the cylinder 111. The closing spring 52, accommodated in a spring space 55 located in the cylinder 111, bears, on the side facing away from the closing member 51, against a supporting member in the form of a piston 53 axially adjustable in the cylinder 111 preferably between two stops 87 and 88. The adjustable piston 53 is subjected, on the side located opposite the closing spring 52, to the fuel pressure via a connecting line 56 which is connected to the relief line 24 upstream of a delivery valve 23 located in the relief line 24. This fuel pressure also prevails in the return chamber 21. An outlet line 57 leads from the spring space 55 of the cylinder 111 of the delivery valve 50 and opens into the suction line 48 of the feed pump.

To influence the fuel pressure in dependence on the temperature during the starting of the internal combustion engine, the delivery valve 23 is arranged in the relief line 24 leading away from the return chamber 21 of the pressure-control valve 7. The relief line 24 leads to a shut-off chamber 25 of the delivery valve 23. An actuating member 26 of an element 27 working in dependence on temperature, for example, of an element made of expanding material or as a bimetallic spring, projects into the shut-off chamber 25. The actuating member 26 engages a movable valve-closing member 28 arranged in the delivery valve 23 and loaded by a return spring 29 located in a spring chamber 30. The valve-closing member 28 is moved into the opening position of the delivery valve 23 by the actuating member only when the element 27 working in dependence on temperature is activated, that is to say only at a minimum operating temperature of the internal-combustion engine. A control line 32 branches off from the relief line 24 downstream of the connection with the delivery valve 23, leads to a cold-start regulating valve 8 and enters there via an inlet orifice 33 in the circumferential wall of a cylinder 35 of the regulating valve 8. A connecting line 4 connects the distributor 6 with a pressure chamber 39 of the cylinder 35 which chamber is limited on one side by the end face of the cylinder 35. On the other side, the pressure chamber 39 is limited by one end face of the control piston 34 axially displaceable in the cylinder 35 and loaded by a compression spring 36 supported on an adjustable stop 37. Arranged in the control piston 34, is an annular groove 41, one limiting edge of which forms a control edge controlling the inlet orifice 33. The annular groove 41 is connected by radial bores 42 to a blind bore 43 which is arranged axially in the control piston 34 and which extends from the other end face of the control piston 34 loaded by the compression spring 36 and closing off a spring chamber 40 in the cylinder. From the spring chamber 40, there is a connecting line 45 to the spring chamber 30 of the outlet valve 23. An outlet line 47 branches off from this connecting line 45 and is connected to the feed-pump suction line 48.

Figure 2:
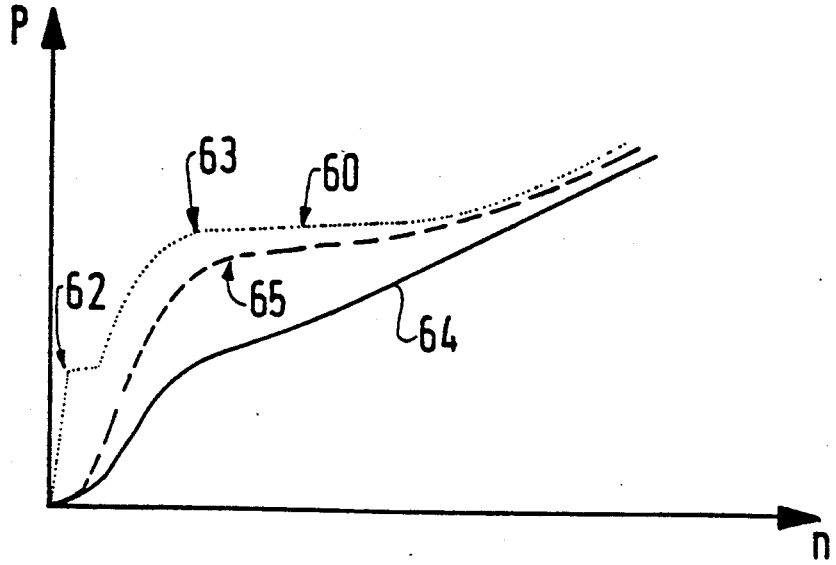
FIG. 2 shows a diagram of pressure variations with the cold-start function in comparison with normal functioning.

The arrangement according to FIG. 1, when it functions, produces a speed/pressure characteristic such as shown in FIG. 2. The arrangement according to FIG. 1 functions as follows:

When the internal-combustion engine is started below the operating temperature, the actuating member 26 is lifted off from the valve-closing member 28, and the delivery valve 23 is closed. The adjusting piston 11 is in the "retarded position" until the starting speed is reached. Because the pressure-control valve 7 is closed, with the pressure valve 50 closed at the same time, no fuel can flow off, and therefore a control pressure builds up quickly in the suction gallery 14 and the working chamber 12 and causes a displacement of the adjusting piston 11 into the "advanced" position. Thus, because the pressure valve 50 is closed, even at a low speed a steep rise of the pressure in the suction gallery 14 is obtained, as can be seen from FIG. 2 as far as point 62. At point 62, the pressure valve 50 according to the invention opens when a predetermined opening pressure is reached. Now, when, with the pressure compensation caused by the closed outlet valve 23 and the throttle 22, the piston 16 of the pressure-control valve 7 cannot close the shut-off orifice 19 completely, because of constructional conditions and settings, for the entire course of the change of the control pressure in relation to the engine speed, the fuel can flow off via the shut-off orifice 19 and the outlet line 20 past the closing member 51 of the pressure valve 50 into the spring chamber 55. The fuel flows from the spring chamber 55 via the further outlet line 57 into the feed pump suction line 48. After the opening of the pressure valve 50, the pressure first remains virtually constant, but then, with a further increase in speed of the feed pump 1, rises according to the characteristic segment 63. Here, the throttling of the partially opened shut-off orifice 19 acts, in conjunction with the increased feed rate of the feed pump 1, in such a way that, despite the flow-off of a small quantity of fuel, a desirable increase of the control pressure is achieved, in order to obtain the necessary advance of the start of injection when the internal-combustion engine is cold and is not yet running hot. In this characteristic segment 63, the fuel pressure is controlled, on the one hand, by the shut-off cross-section of the shut-off orifice 19 and, on the other hand, by the opening pressure acting on the closing member 51 which moves against the force of the closing spring 52.

Now the closing force of the closing spring 52, which is supported on the piston 53 subjected to the pressure prevailing in the relief line 24, can be influenced additionally, when the opening pressure of the pressure valve 50 is increased with an increase in pressure in the return chamber 21 of the pressure-control valve 7. This pressure being equal to in the pressure chamber 18 of the pressure valve 7 and the working chamber 12 of the injection adjusting device 9 when the delivery valve 23 still closed. When the piston 53 comes up against its stop 87 located on the same side as the spring, the increase of the opening pressure is terminated. The point 62 corresponds to this opening pressure. However, if the piston 53, as a supporting member of the closing spring 52, is not loaded by the pressure in the return chamber 21 or in the relief line 24 upstream of the outlet valve 23, the pressure valve has an opening pressure which is determined by the other stop 88 of the piston 53 and which is invariable, but can also be adjustable. At the point 63, by means of the annular groove 41 on the control piston 34 displaced by the control pressure, the cold-start regulating valve 8 begins to open the inlet orifice 33 according to an opening pressure finely adjustable at the stop 37.

This results in a low rise of the control pressure because a quantity of fuel now flows off at the regulating valve 8 according to the characteristic line 60. In the upper speed range, the regulating valve 8 serves as a pressure-dependent device, via which, by means of the shut-off edges of the annular groove 41 and of the cylinder orifice 33, there is an increasing relief, as a result of which the control-pressure line 60 approximates to the control-pressure line 64 when the internal-combustion engine is running hot.

The characteristic line 65 reveals a pressure/speed behaviour which would occur without the pressure valve 50 according to the invention. At a lower speed, the pressure does not rise so steeply in relation to the speed as with the pressure valve 50 according to the invention. At higher speeds, under the control of the regulating valve 8, the characteristic lines 60 and 65 have virtually the same characteristic.

Figure 3:
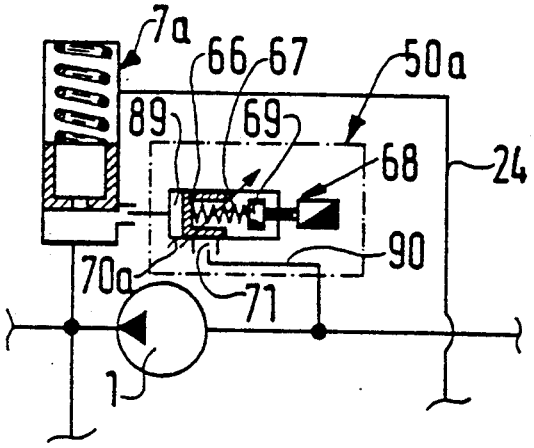
FIGS. 3, 4 and 5 show different constructions of the pressure valve.

The same pressure/speed behaviour is also obtained with an arrangement according to FIG. 3.

FIG. 3 shows an alternative arrangement of the construction which is otherwise the same. A pressure-holding valve 50*a* has a valve piston 66 which works as a closing member and is loaded by a closing spring 67 having an adjustable preload and which on its end face limits, in the valve housing 70*a*, a pressure chamber 89 into which the outlet line 20 opens and from which, under the control of the end face of the valve piston, a connecting line 90 leads away to the feed-pump suction line 48. On the side located opposite the valve piston 66, the closing spring 67 bears against a supporting member 69 axially movable in the valve cylinder 70*a* of the pressure valve 50. The supporting member 69 is adjustable by an electrically actuatable device 68. The electrical device 68 is activated by control signals which are generated by a speed-detecting measuring means or by a pressure sensor. The opening pressure of the pressure valve 50*a* is controlled according to the speed or the pressure and, when it is reached, a shut-off orifice 71 formed in the valve cylinder 70*a* provides for opening and closing a connection between the outlet line 20 and the connecting line 90. In addition to influencing the control-pressure characteristic of the injection start adjusting device according to the Curve 62, 63, 60 of FIG. 2, the pressure valve 50*a* can also modify the control pressure when the internal-combustion engine is running hot, according to operating parameters of the internal-combustion engine.

Figure 4:
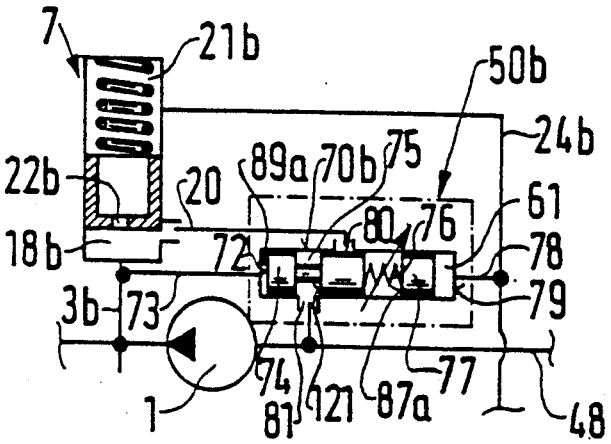

The arrangement according to FIG. 4 shows a pressure valve 50*b* with a valve cylinder 70*b*, from one end face 72 of which a connecting line 73 leads to the connecting line 3*b* coming from the feed pump 1. There slides axially displaceably in the valve cylinder 70*b* a valve piston 74 which works as a closing member and which limits a pressure chamber 89*a* in the valve cylinder 70*b* with the end face 72 and, in the outer surface, has an annular groove 75, of which one limiting edge 121 serves as a control edge. A closing spring 76 of variable preload bears against that side of the valve piston 74 located opposite the end face 72. The other end of this closing spring 76 acts against a piston 77 which is likewise displaceable axially in the valve cylinder 70*b* and which forms a pressure space 61 towards the second end face 79 of the valve cylinder 70*b*. A connecting line 78 leads from this second end face 79 to the relief line 24*b* upstream of the delivery valve 23. Arranged on the circumference of the valve cylinder 70*b* are two cutback orifices, of which one, the shut-off orifice 81, is connected constantly to the annular groove and at the same time is connected to the feed-pump suction line 48. The outlet line 20 of the pressure-control valve 7 enters the other shut-off orifice 80 located approximately in the middle of the valve cylinder 70*b*. This shut-off orifice 80 is so arranged that, during the starting of the feed pump 1, the annular groove 75 has no overlap with the shut-off orifice 80, and consequently fuel can still not flow off, and pressure is not reduced. The feed pump 1 generates a pressure which builds up in the connecting line 73 and in the pressure chamber 18*b* of the pressure-control valve 7 via the connecting line 3*b* and which, in a similar way to the preceding exemplary embodiments, results, with the pressure valve 50*b* being closed, in a steep rise of the control pressure and an advance of the start of injection. Via the connecting line 73, the valve piston 74 is subjected to the control pressure to be set and would be displaced axially and open the outlet line 20 via the annular groove 75 if, with the delivery valve 23 closed, the control pressure were not in the return chamber 21*b* via the throttle 22*b* and did not also enter the pressure space 61 via the relief line 24*b* on the connecting line 78. This control pressure therefore also acts on the piston 77 of a diameter larger than that of the valve piston 74 and presses onto the valve piston 74 via the piston 77 and the closing spring 76 of adjustable prestress.

The opening pressure of the pressure valve 50*b* is influenced in this way, specifically in dependence on the steep rise in pressure of the control pressure to be controlled. Here too, the opening pressure can be limited by a stop 87*a* limiting the travel of the piston 77 in the direction of the closing spring 76.

Figure 5:
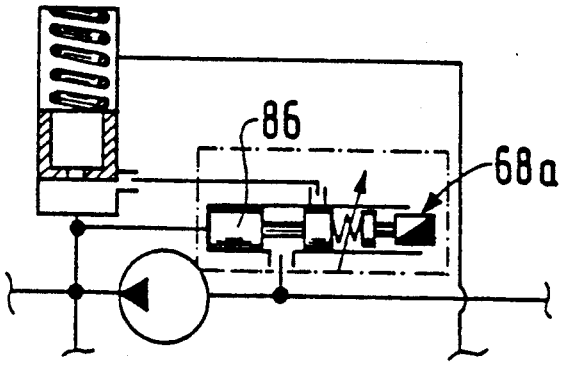

FIG. 5 shows a valve piston 86 which works as a closing member and which corresponds to the valve piston 74 of FIG. 4. In the arrangement according to FIG. 5, the piston 77 of FIG. 4, controllable as a function of pressure, is replaced by an electrically controllable device 68*a* which corresponds to the device 68 of FIG. 3. In this arrangement according to FIG. 5, therefore, the pressure is measured by a pressure sensor which produces a control signal for the electrically actuatable device.

While the invention has been illustrated and described as embodied in a fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fuel-injection pump for an internal combustion engine, in particular a distributor fuel injection pump, comprising a feed pump driven synchronously with the fuel injection pump for providing control pressure; a pressure control valve having a pressure chamber; a timer having a pressure chamber; conduit means for communicating said feed pump with said pressure chambers of said pressure control valve and said timer; said pressure control valve further including a return chamber, a constant throttle connecting said pressure chamber of said pressure control valve and said return chamber, a shut-off orifice, a displaceable piston, and a return spring located in said return chamber for biasing said piston to a position in which it closes said shut-off orifice said piston being displaceable against the bias of said return spring for controlling flow through said shut-off orifice; an adjustable delivery valve; a relief conduit communicating said return chamber of said pressure control valve with said adjustable outlet valve; an outlet conduit extending from said shut-off orifice of said pressure control valve; and a pressure valve arranged in said outlet conduit for controlling flow therethrough, said pressure valve including a closing member for controlling flow in said outlet conduit, and a closing spring having an adjustable preload for biasing said closing member into a closed position of said pressure valve.

2. A fuel injection pump according to claim 1, wherein said pressure valve further includes a cylinder in which said closing member is displaceable, an axially movable member for supporting said closing spring, and means for applying to said axially movable member a pressure prevailing in said return chamber of said pressure control valve, which pressure acts in a direction opposite to a direction in which said return spring biases said axially movable member.

3. A fuel injection pump according to claim 2, further comprising electrically actuatable means for adjusting a position of said axially movable supporting member as a function of operating parameters of an internal combustion engine.

4. A fuel injection pump according to claim 3, wherein said pressure valve comprises stops for limiting displacement of said axially movable supporting member.

5. A fuel injection pump according to claim 3, wherein said axially movable supporting member is adjustable in accordance with a temperature.

6. A fuel-injection pump for an internal combustion engine, in particular a distributor fuel injection pump, comprising a feed pump driven synchronously with the fuel injection pump for providing control pressure; a pressure control valve having a pressure chamber; a timer having a pressure chamber; conduit means for communicating said feed pump with said pressure chambers of said pressure control valve and said timer; said pressure control valve further including a return chamber, a constant throttle connecting said pressure chamber of said pressure control valve and said return chamber, a shut-off orifice, a displaceable piston, and a return spring located in said return chamber for biasing said piston to a position in which it closes said shut-off orifice said piston being displaceable against the bias of said return spring for controlling flow through said shut-off orifice; an adjustable outlet valve; a relief conduit communicating said return chamber of said pressure control valve with said adjustable outlet valve; an outlet conduit extending from said shut-off orifice of said pressure control valve; and a pressure valve arranged in said outlet conduit for controlling flow therethrough.

7. A fuel injection pump according to claim 6, wherein said pressure valve includes a cylinder, a piston slide slideable in said cylinder for controlling flow through said exhaust conduit, and a closing spring located in said cylinder for biasing said piston slide to a closing position thereof in which it blocks flow through said exhaust conduit, said piston slide being displaceable against bias of said closing spring to an open position thereof in accordance with a pressure prevailing in said pressure chamber of said pressure control valve.

8. A fuel injection pump according to claim 7, wherein said piston slide has an outer surface, and an annular groove formed on said outer surface and defining a control edge for controlling flow through said cylinder of said pressure valve.

9. A fuel injection pump according to claim 6, further comprising control means for controlling operation of said outlet valve in such a manner that said return chamber of said pressure control valve is relieved independently of whether a closing pressure of said outlet valve is reached when the internal combustion engine is running hot.

10. A fuel injection pump according to claim 6, further comprising control means for controlling operation of said outlet valve in such a manner that said return chamber of said pressure control valve is relieved independently of whether a closing pressure of said outlet valve is reached when the internal combustion engine reaches a predetermined speed.

11. A fuel injection pump according to claim 9, wherein said outlet valve comprises a valve seat, a closing member engageable with said valve seat, and a spring for biasing said closing member into engagement with said valve seat, said control means comprising a control member for lifting said closing member off said valve seat in response to the internal combustion engine reaching a predetermined operating temperature.

* * * * *